US011702307B2

(12) United States Patent
Wang et al.

(10) Patent No.: US 11,702,307 B2
(45) Date of Patent: Jul. 18, 2023

(54) PAPER WINDING MACHINE

(71) Applicant: Shaanxi University of Science & Technology, Xi'an (CN)

(72) Inventors: Dan Wang, Xi'an (CN); Liyue Wu, Xi'an (CN); Yanjun Li, Xi'an (CN)

(73) Assignee: Shaanxi University of Science & Technology, Xi'an (CN)

( * ) Notice: Subject to any disclaimer, the term of this patent is extended or adjusted under 35 U.S.C. 154(b) by 29 days.

(21) Appl. No.: 17/530,005

(22) Filed: Nov. 18, 2021

(65) Prior Publication Data

US 2022/0219927 A1 Jul. 14, 2022

(30) Foreign Application Priority Data

Jan. 14, 2021 (CN) ..... 202110049937.8

(51) Int. Cl.
*B65H 18/10* (2006.01)
*B65H 1/10* (2006.01)

(52) U.S. Cl.
CPC ..... *B65H 1/10* (2013.01)

(58) Field of Classification Search
None
See application file for complete search history.

(56) References Cited

U.S. PATENT DOCUMENTS 1,257,404 A * 2/1918 Ross ..... B65H 19/28 242/532.5
1,377,169 A * 5/1921 Maize ..... A47F 7/166 242/532.5
3,051,446 A * 8/1962 Nelson ..... B66D 1/06 254/356
3,695,561 A * 10/1972 Pitts ..... B65H 75/246 242/571.6
3,936,007 A * 2/1976 Butz ..... B65H 18/10 242/532.6
3,964,373 A * 6/1976 Christen, Jr. ..... B31C 99/00 242/598.3
4,165,678 A * 8/1979 Hart ..... B65B 63/04 242/546
4,192,226 A * 3/1980 Agostinelli ..... B65B 63/04 242/532.6
4,357,140 A * 11/1982 Phillips ..... B31C 1/00 242/546
4,551,127 A * 11/1985 Rich ..... A63H 33/04 493/462

(Continued)

*Primary Examiner* — William A. Rivera
(74) *Attorney, Agent, or Firm* — Dicke, Billig & Czaja, PLLC

(57) ABSTRACT

A paper winding machine is provided. The paper winding machine includes a frame body, wherein a winding roller is installed on the frame body in a horizontal direction, two winding roller adjusting mechanisms are respectively installed at two ends of and inside the winding roller, one end of the winding roller is connected with one end of a first rotating shaft, the other end of the winding roller is connected with one end of a second rotating shaft, the other end of the first rotating shaft and the other end of the second rotating shaft are installed on the frame body via bearing seats respectively, a crank handle is provided at the other end of the first rotating shaft, and a through groove is formed in an outer wall of the winding roller and formed in a length direction of the winding roller.

8 Claims, 4 Drawing Sheets

(56) References Cited

U.S. PATENT DOCUMENTS 5,388,782 A * 2/1995 King ..... E04H 17/266
242/586.5
5,533,687 A * 7/1996 Tice ..... G03B 27/588
242/532.5
7,077,357 B2 * 7/2006 Taki ..... A63H 33/16
52/750

* cited by examiner

PAPER WINDING MACHINE

CROSS REFERENCE TO RELATED APPLICATION

This patent application claims the benefit and priority of Chinese Patent Application No. 202110049937.8 filed on Jan. 14, 2021, the disclosure of which is incorporated by reference herein in its entirety as part of the present application.

TECHNICAL FIELD

The present disclosure belongs to the technical field of paper winding equipment, and relates to a paper winding machine.

BACKGROUND ART

At present, students majored in drawing need to draw and print drawings on papers frequently, most of the drawing papers need to be manually wound after being printed. The manual winding is low in efficiency, and may be uneven. There is currently a drawing paper winding device, and the drawing paper wound by the device is tightly wound on a winding roller, and is not easily separated from the winding roller, thus a next winding operation is affected, thereby resulting in low paper winding efficiency.

SUMMARY

The present disclosure aims to provide a paper winging machine to solve the problem that existing paper winding efficiency is low and the paper is not easy to being separated from a winding roller.

Through the technical solution provided in the present disclosure, the paper winding machine comprises a frame body, wherein a winding roller is installed on the frame body in a horizontal direction, two winding roller adjusting mechanisms are respectively installed at two ends of and inside the winding roller, one end of the winding roller is connected with one end of a first rotating shaft, another end of the winding roller is connected with one end of a second rotating shaft, another end of the first rotating shaft and another end of the second rotating shaft are installed on the frame body via respective bearing seats, a crank handle is provided at the another end of the first rotating shaft, and a through groove is formed in an outer wall of the winding roller and formed in a length direction of the winding roller.

The paper winding machine also may have the following characteristics:

The winding roller may include a plurality of arc-shaped plates, the arc-shaped plates may be sequentially joined to form a cylindrical structure, and the through groove may be formed in the arc-shaped plates.

The arc-shaped plates may include three arc-shaped plates, and the two winding roller adjusting mechanisms may be respectively arranged at two ends of the three arc-shaped plates.

The winding roller adjusting mechanisms may include hollow adjusting cylinders, a triangular adjusting block may be arranged at one end of each of the adjusting cylinders, three side faces of the adjusting block may be connected with three telescopic mechanisms respectively, and the three telescopic mechanisms may be connected with the three arc-shaped plates respectively.

Another ends of the adjusting cylinders in the two sets of winding roller adjusting mechanisms may be respectively connected with the one end of the first rotating shaft and the one end of the second rotating shaft.

The first rotating shaft and the second rotating shaft may be respectively and coaxially mounted into the adjusting cylinders by means of threaded connection.

The three telescopic mechanisms each may include a sleeve, one end of the sleeve may be fixed to a corresponding side face of the three side faces of the adjusting block, a first spring may be coaxially sleeved into the sleeve, another end of the sleeve may be coaxially sleeved with one end of a telescopic rod, another end of the telescopic rod may be fixed to a center of an inner wall of a corresponding arc-shaped plate of the three arc-shaped plates, one end of the first spring may be fixed to the corresponding side face of the adjusting block, another end of the first spring may be fixed to the one end of the telescopic rod, and an adjusting rod may be connected to an outer wall of the telescopic rod.

The frame body may be of a U-shaped structure, and a pressing unit may be arranged between a bottom of the frame body and the winding roller.

The pressing unit may include a supporting plate, two ends of a lower end face of the supporting plate may be hinged to the bottom of the frame body, a flat plate may be arranged on an upper end face of the supporting plate and tangent to the outer wall of the winding roller, and a plurality of elastic components may be provided between the lower end face of the supporting plate and the bottom of the frame body.

The elastic components may be second springs, and the second springs may be arranged at intervals in the length direction of the frame body.

An anti-reverse mechanism may be arranged between the crank handle and the frame body, the anti-reverse mechanism includes a ratchet wheel coaxially assembled on an output shaft of the crank handle, the ratchet wheel may be fitted with a pawl, and the pawl may be connected to an outer wall of the frame body via a roll pin and rotate around the roll pin.

The paper winding machine has the beneficial effects that one end of the paper is clamped in the through groove of the winding roller, the output shaft of the crank handle is rotated to drive the winding roller to rotate, and the winding roller drives the drawing to be wound. After winding is finished, the bearing seats are detached from the frame body, one end of the second rotating shaft of the winding roller is a free end, and then the two adjusting mechanisms are adjusted. The outer wall of the winding roller moves inwards in the radial direction of the winding roller, and then the radius of the winding roller is reduced, so that a gap is formed between the outer wall of the winding roller and the wound paper, which facilitates to detaching the paper from the free end. Then, the adjusting mechanisms are adjusted, the radius of the winding roller is increased and reset, and the winding roller is rotated to an initial position. The bearing seats are fixed to the frame body for a next winding. Through such winding mode, the paper is easy to be separated from the winding roller, for facilitating the next winding operation, and thus the paper winding efficiency is improved.

Figure 1:
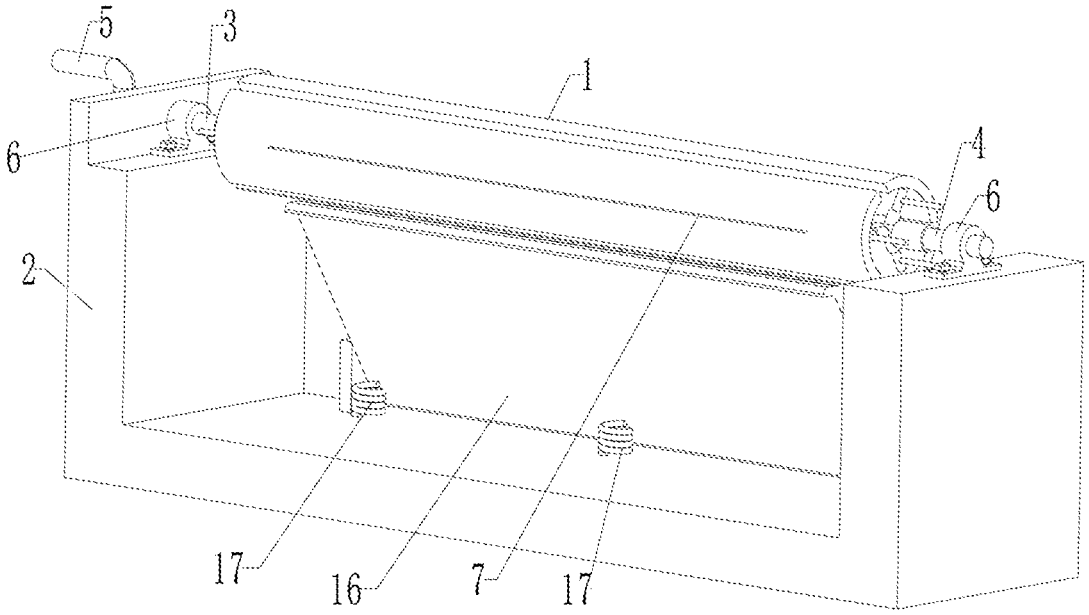
FIG. 1 is a schematic diagram of a structure of a paper winding machine in the present disclosure.

Reference numerals in drawings: 1 arc-shaped plate; 2 frame body; 3 first rotating shaft; 4 second rotating shaft; 5 crank handle; 6 bearing seat; 7 through groove; 8 adjusting cylinder; 9 adjusting block; 10 sleeve; 11 first spring; 12 telescopic rod; 13 adjusting rod; 14 ratchet wheel; 15, pawl; 16, supporting plate; 17, second spring; and 18 flat plate.

DETAILED DESCRIPTION OF THE EMBODIMENTS

The following describes the present disclosure in conjunction with accompanying drawings and detailed description.

A paper winding machine, as shown in FIG. 1, includes a winding roller configured for winding a paper, such as a drawing paper. The winding roller is installed on a frame body 2. Winding roller adjusting mechanisms are arranged at two ends of the winding roller in an axis direction of the winding roller respectively. The winding roller adjusting mechanisms are arranged in the winding roller. The winding roller adjusting mechanisms are configured for adjusting the diameter of the winding roller. The two winding roller adjusting mechanisms are rotationally connected with a first rotating shaft 3 and a second rotating shaft 4 respectively. The axes of the first rotating shaft 3, the second rotating shaft 4 and the winding roller are coincided with each other. The first rotating shaft 3 is coaxially connected with an output shaft of a crank handle 5. The crank handle 5 is rotationally installed on the frame body 2. The second rotating shaft 4 and the first rotating shaft 3 are assembled with bearing seats 6 respectively. The bearing seats 6 are removably installed on the frame body 2, particularly via bolts.

A through groove 7 is formed in the outer wall of the winding roller, and plays a role in clamping an end of the paper. One end of the paper is clamped in the through groove 7 of the winding roller, the output shaft of the crank handle 5 is rotated to drive the winding roller to rotate, and the winding roller drives the paper to be wound. After winding is finished, the bearing seats 6 are detached from the frame body 2, so that one end of the second rotating shaft 2 of the winding roller becomes a free end, and then the two adjusting mechanisms are adjusted. The outer wall of the winding roller moves inwards in the radial direction of the winding roller, so that the radius of the winding roller is reduced, and a gap is formed between the outer wall of the winding roller and the wound paper, which facilitates to detaching the paper from the free end. Then, the adjusting mechanisms are adjusted, the radius of the winding roller is increased and reset, and the winding roller is rotated to an initial position. The bearing seats 6 are fixed to the frame body 2 for a next winding. Through such winding mode, the paper is easy to be separated from the winding roller, for facilitating the next winding operation, and thus the paper winding efficiency is improved.

Figure 2:
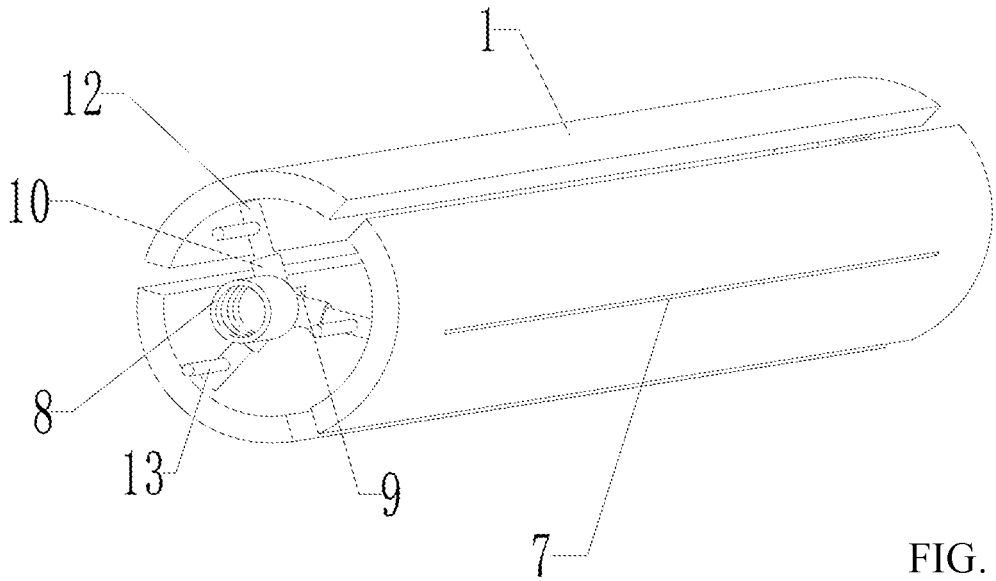
FIG. 2 is a schematic diagram of structures of a winding roller and an adjusting mechanism in the present disclosure.

The specific structure of the winding roller is that, as shown in FIG. 2, the winding roller includes a plurality of arc-shaped plates 1, specifically three arc-shaped plates 1. The three arc-shaped plates 1 are mutually independent and define a cylindrical structure. As a point of reference, the view of FIG. 4 reflects an arrangement of the arc-shaped plates 1 relative to one another as dictated by a normal state of the winding roller adjustment mechanisms; as shown, circumferentially adjacent sides of the arc-plates 1 are separated from one another by a gap, and with the arc-shaped plates 1 collectively defining a cylindrical shape or structure (e.g., in the view of FIG. 4, the cylindrical structure collectively defined the arc-shaped plates 1 is effectively a discontinuous cylinder in view of the gap between successively adjacent ones of the arc-shaped plates 1). The through groove 7 is formed in at least one of the arc-shaped plates 1. In some embodiments, each of the arc-shaped plates 1 can form a corresponding through groove 7. Each arc-shaped plate 1 extends from one end of the first rotating shaft 3 to the second rotating shaft 4 in the axis direction of the second rotating shaft 4.

Figure 3:
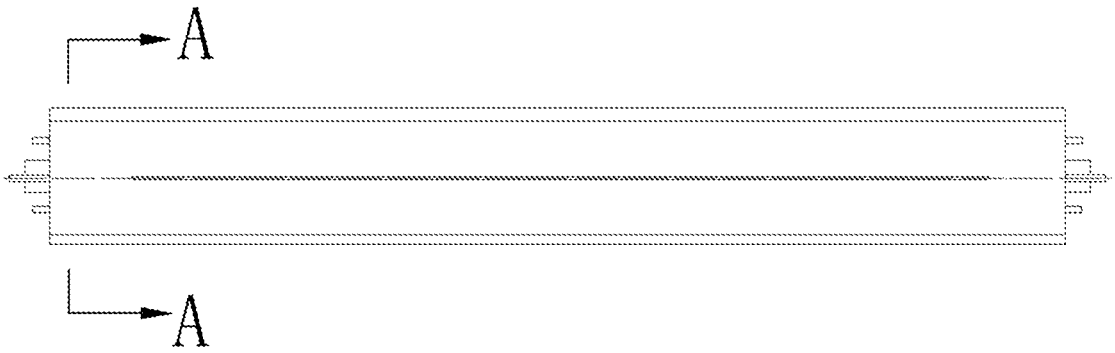
FIG. 3 is a left view of the winding roller and the adjusting mechanism of FIG. 2.
Figure 4:
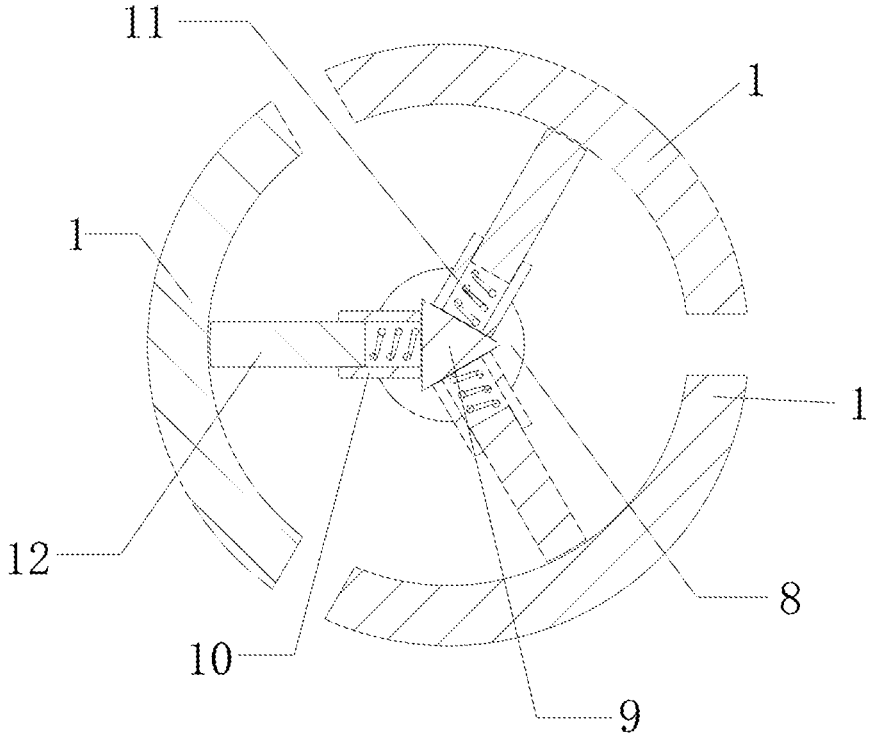
FIG. 4 is a cross-sectional view of the adjusting mechanism and the winding roller in the present disclosure taken from a line A-A in FIG. 3.

As shown in FIGS. 2 to 4, the two winding roller adjusting mechanisms are the same in structures, and the two winding roller adjusting mechanisms are connected with the first rotating shaft 3 and the second rotating shaft 4 in the same mode. Now, the connection of the winding roller adjusting mechanism and the first rotating shaft 3 is described as an example. The specific structure of the winding roller adjusting mechanism is that the adjusting mechanism includes an adjusting cylinder 8, which is sleeved on the first rotating shaft 3, and is threadedly connected with the first rotating shaft 3; an adjusting block 9 is formed at the end, away from the first rotating shaft 3, of the adjusting cylinder 8, and is provided with telescopic mechanisms, which are arranged at the position corresponding to the centers of arc-shaped plates 1 respectively, and are configured for enabling respective arc-shaped plate 1 to expand outwards or contract inwards in the radial direction of the arc-shaped plate 1. Therefore, the diameter of the winding roller is adjusted.

The specific structure of the telescopic mechanism is that the telescopic mechanism includes sleeves 10, the number of the sleeves 10 is the same as that of the arc-shaped plates 1. The sleeve 10 is formed on the periphery surface of the adjusting block 9. The axes of the sleeve 10 are mounted at a center position of a respective arc-shaped plate 1. A first spring 11 is fixedly connected to the internal bottom of the sleeve 10, one end of the first spring 11 is fixedly connected with the internal bottom of the sleeve 10, and the other end of the first spring 11 is fixedly connected with the telescopic rod 12 in the sleeve 10. The telescopic rod 12 extends outwards in the axis direction of the sleeve 10 to the respective arc-shaped plate 1 and is integrally formed with the arc-shaped plate 1. An adjusting rod 13 extending outwards in the axis direction of the winding roller is integrally formed on each telescopic rod 12.

According to the specific mode of adjusting the diameter of the winding roller, after the paper is wound by the winding roller, the paper needs to be separated from the winding roller. Firstly, all adjusting rods 13 are pressed in a direction close to the sleeve 10 in the axis direction of the telescopic rod 12 by an external force, so that the diameter of the winding roller is reduced, and the paper is easily taken down from the winding roller. Then, the external force acting on the adjusting rods 13 is cancelled, the first springs 11 support the telescopic rods 12 to expand outwards under the action of elastic potential energy, the telescopic rods 12 support the arc-shaped plates 1 to move outwards, and therefore the winding roller is reset, and the next winding operation can be conducted.

Figure 5:
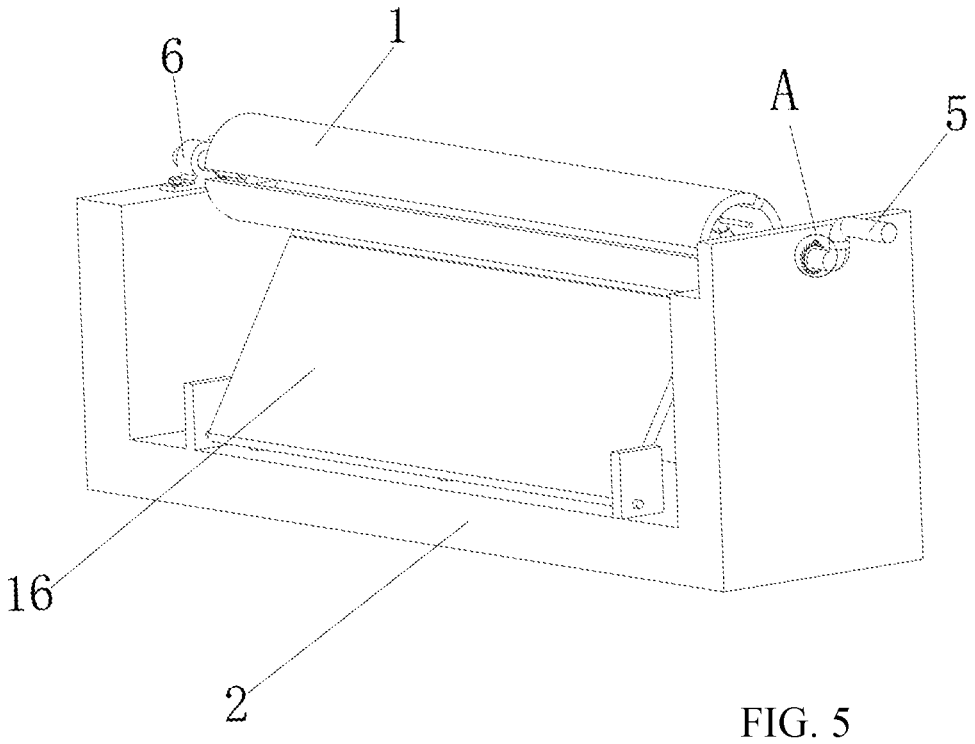
FIG. 5 is a schematic diagram of a structure of a paper winding machine viewed from another direction in the present disclosure.
Figure 6:
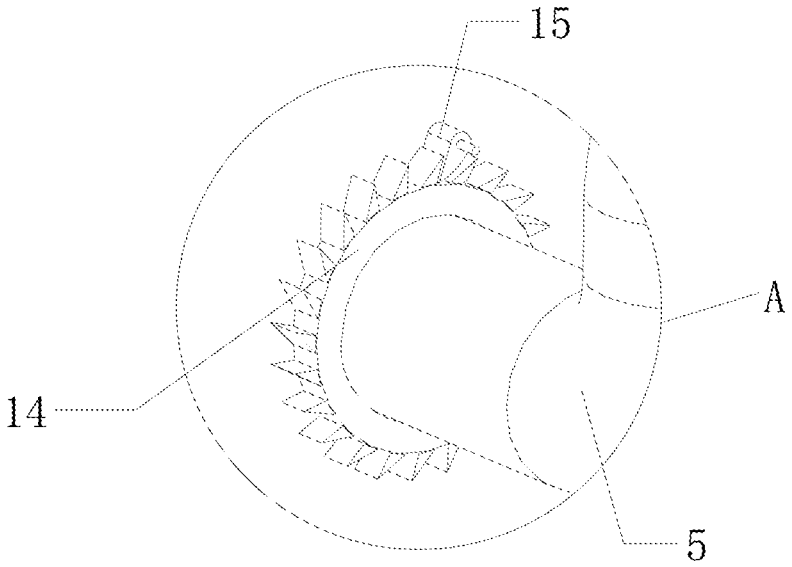
FIG. 6 is an enlarged view of part A in FIG. 4.

As shown in FIG. 5 and FIG. 6, specifically, an anti-reverse mechanism is provided between the crank handle 5 and the frame body 2 and configured for preventing the crank handle 5 from rotating reversely. The specific structure of the anti-reverse mechanism includes a ratchet wheel brake unit, and the ratchet wheel brake unit includes a ratchet wheel 14 coaxially assembled on an output shaft of the crank handle 5. A pawl 15 matched with the ratchet wheel 14 is rotationally connected to the outer wall of the frame body 2 via a roll pin.

Figure 7:
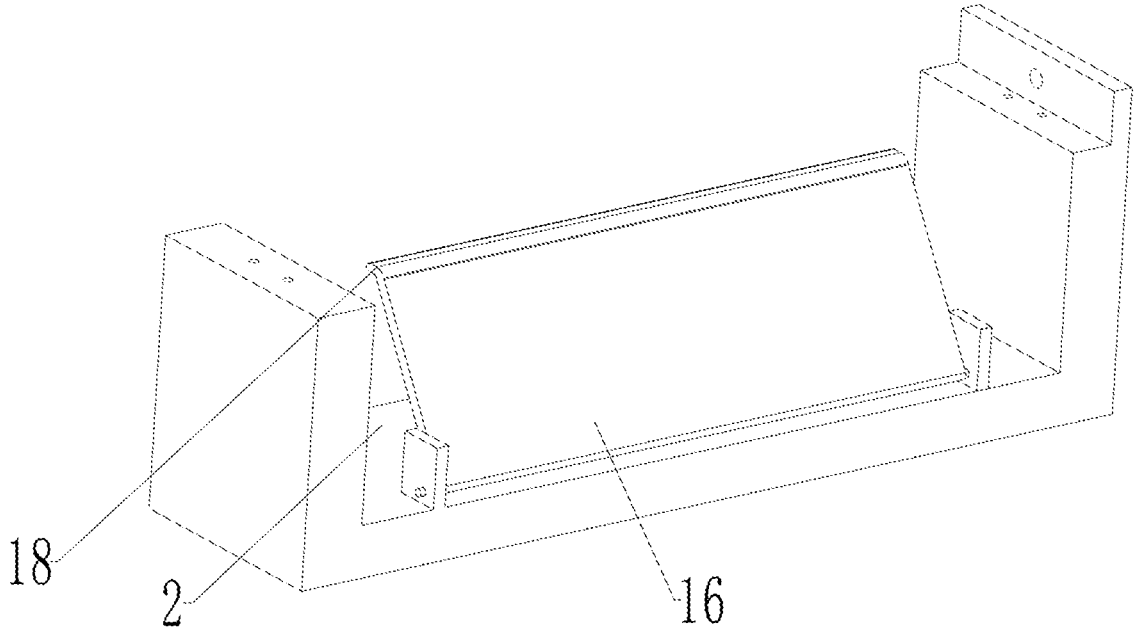
FIG. 7 is a schematic diagram of structures of a frame body and a supporting plate in a paper winding machine in the present disclosure.

As shown in FIG. 1 and FIG. 7, a pressing unit is installed on the frame body 2 and configured for winding the paper more compactly. The specific structure of the pressing unit includes a supporting plate 16. The supporting plate 16 is rotationally connected to the bottom of the frame body 2. Elastic components are fixedly connected between the supporting plate 16 and the bottom of the frame body 2, and can enable the supporting plate 16 to move in a vertical direction. A flat plate 18 is formed at the end, away from the bottom of the frame body 2, of the supporting plate 16 and tangent to the outer wall of the winding roller. When the paper is wound by the winding roller, the elastic components drive the flat plate 18 to abut against the paper wound on the winding roller, and therefore the paper is wound more compactly.

The specific structures of the elastic components are that the elastic components include a plurality of second springs 17. The second springs 17 are arranged at intervals in the length direction of the frame body 2. The second springs 17 are fixedly connected with the supporting plate 16 and the bottom of the frame body 2 respectively. The second springs 17 drive the flat plate 18 of the supporting plate 16 to abut against the outer wall of the winding roller. When the paper is wound, the flat plate 18 abuts against the wound paper under the action of the second springs 17, so that the paper is wound more compactly and flatly.

What is claimed is:

1. A paper winding machine, comprising:

a frame body;

a winding roller installed on the frame body in a horizontal direction, the winding roller defining opposing, first and second ends;

wherein the winding roller defines a through groove in an outer wall thereof, the through groove extending in a length direction of the winding roller;

first and second winding roller adjusting mechanisms installed at the first and second ends, respectively, and to an inside of, the winding roller;

a first rotating shaft rotatably maintained relative to the frame body by a first bearing seat, the first rotating shaft defining first and second ends, wherein the first end of the first rotating shaft is connected with the first end of the winding roller;

a crank handle connected to the second end of the first rotating shaft; and a second rotating shaft connected to the second end of the winding roller and rotatably maintained relative to the frame body by a second bearing seat;

wherein the winding roller comprises three arc-shaped plates, the three arc-shaped plates are sequentially joined to form a cylindrical structure, the through groove is formed in at least one of the arc-shaped plates, and the first and second winding roller adjustment mechanisms are respectively arranged at two ends of the three arc-shaped plates.

2. The paper winding machine of claim 1, wherein the first and second winding roller adjusting mechanisms each comprise:

a hollow adjusting cylinder defining a first end opposite a second end;

a triangular adjusting block arranged at the first end of the hollow adjusting cylinder, the triangular adjusting block defining three side faces; and three telescopic mechanisms, wherein a respective one of the three telescoping mechanisms is connected to a corresponding one of the three side faces and to a corresponding one of the three arc-shaped plates;

wherein the second end of the hollow adjusting cylinder of the first winding roller adjustment mechanism is connected to the first end of the first rotating shaft, and the second end of the hollow adjusting cylinder of the second winding roller adjusting mechanism is connected to the first end of the second rotating shaft.

3. The paper winding machine of claim 2, wherein the first rotating shaft and the second rotating shaft are respectively and coaxially sleeved into the corresponding hollow adjusting cylinder by means of threaded connection.

4. The paper winding machine of claim 2, wherein the three telescopic mechanisms each comprise:

a sleeve, wherein one end of the sleeve is fixed to a corresponding side face of the three side faces of the triangular adjusting block;

a spring coaxially received within the sleeve, the spring defining a first end opposite a second end, wherein the first end of the spring is fixed to the corresponding side face of the three side faces of the triangular adjusting block;

a telescopic rod defining a first end opposite a second end, wherein the first end of the telescopic rod is coaxially received within the sleeve, and further wherein the second end of the telescopic rod is fixed to a center of an inner wall of a corresponding arc-shaped plate of the three arc-shaped plates;

wherein the second end of the spring is fixed to the first end of the telescopic rod; and an adjusting rod connected to an outer surface of the telescopic rod.

5. The paper winding machine of claim 1, wherein the frame body is defined by a U-shaped structure, the paper winding machine further comprising a pressing unit arranged between a bottom of the frame body and the winding roller.

6. The paper winding machine of claim 5, wherein the pressing unit comprises:

a supporting plate, defining a lower end face opposite an upper end face, wherein the lower end face is hingedly connected to the bottom of the frame body;

a flat plate arranged on the upper end face of the supporting plate such that a major plane defined by the flat plate is tangent to the outer wall of the winding roller; and a plurality of elastic components provided between the lower end face of the supporting plate and the bottom of the frame body.

7. The paper winding machine of claim 6, wherein each of the elastic components of the plurality of elastic components are springs, and further wherein the springs are arranged at intervals in a length direction of the frame body.

8. The paper winding machine of claim 1, further comprising an anti-reverse mechanism arranged between the crank handle and the frame body, the anti-reverse mechanism comprising:

a ratchet wheel coaxially assembled to the crank handle; and a pawl connected to a surface of the frame body via a roll pin such that the pawl can rotate about the roll pin and is arranged to interface with the ratchet wheel.

* * * * *